US007044729B2

(12) United States Patent
Ayastuy et al.

(10) Patent No.: US 7,044,729 B2
(45) Date of Patent: May 16, 2006

(54) GAS BURNER CONTROL FOR A BAKE OVEN

(75) Inventors: Iñaki Ayastuy, Bergara (ES); Gonzalo Fernández, Elorrio (ES)

(73) Assignee: Fagor, S. Coop., Mondragon (ES)

( * ) Notice: Subject to any disclaimer, the term of this patent is extended or adjusted under 35 U.S.C. 154(b) by 33 days.

(21) Appl. No.: 10/831,495

(22) Filed: Apr. 22, 2004

(65) Prior Publication Data

US 2005/0170302 A1 Aug. 4, 2005

(30) Foreign Application Priority Data

Jan. 30, 2004 (ES) ..... 200400190 U

(51) Int. Cl.
*F23N 5/12* (2006.01)

(52) U.S. Cl. ..... 431/25; 431/6; 431/70; 431/71; 431/73; 431/74; 431/75

(58) Field of Classification Search ..... 431/6, 431/25, 69–75, 77, 78; 236/15 A, 20 R
See application file for complete search history.

(56) References Cited

U.S. PATENT DOCUMENTS 2,363,451 A * 11/1944 Stockstrom ..... 60/530
3,630,648 A * 12/1971 Hulsman ..... 431/80
3,701,137 A * 10/1972 Hulsman ..... 431/13
3,832,123 A * 8/1974 Walbridge ..... 431/78
3,880,353 A * 4/1975 Tyler ..... 236/9 R
3,963,410 A * 6/1976 Baysinger ..... 431/46
4,207,054 A * 6/1980 Sobole ..... 431/69
4,318,687 A * 3/1982 Inoue ..... 431/54
4,405,299 A * 9/1983 Serber ..... 431/78
5,169,303 A * 12/1992 Paluck ..... 431/74
6,322,352 B1 * 11/2001 Zink ..... 431/27
6,634,351 B1 * 10/2003 Arabaolaza ..... 126/39 G
6,666,676 B1 * 12/2003 Rodriguez-Rodriguez et al. ..... 431/67
6,698,417 B1 * 3/2004 Frasnetti ..... 126/39 N
2002/0086255 A1 * 7/2002 Chen ..... 431/51
2005/0019716 A1 * 1/2005 Fernandez et al. ..... 431/24

FOREIGN PATENT DOCUMENTS

GB 2249382 A * 5/1992

* cited by examiner

*Primary Examiner*—Ehud Gartenberg
*Assistant Examiner*—James G. Barrow
(74) *Attorney, Agent, or Firm*—The Kline Law Firm

(57) ABSTRACT

The system (1) for controlling the combustion (7) of a cooking oven burner (2), comprises in combination a thermostat valve (3) with a rotary hand knob (4) and a non-electric temperature sensor (6) for modulating the burner flame (7), and an electromagnetic safety valve kept open for ignition, and a electronic module (10) supplying in a first moment a DC power supply to the safety valve (8), which is then maintained open by a thermocouple (9) heated by the main flame (7). A common electrode (18) is provided both for electronic flame detection and ignition. During the burner pre-ignition step, the absence of flame detection signal (If) permits the gas flow (G) to be cut off after a short timed interval, irrespective of the thermocouple response. In the event of the AC power supply being cut off, the thermocouple (9) and the thermostat valve (3) keep the burner modulated independently.

4 Claims, 2 Drawing Sheets

GAS BURNER CONTROL FOR A BAKE OVEN

FIELD OF THE INVENTION

The present invention relates to the combustion control in a gas burner of a cooking oven, by means of the use of an non-electric thermostat valve with a rotary control knob, an electromagnetic safety valve fed by a thermocouple, and an electronic circuit for gas ignition and detecting the burner flame for a preset period.

PRIOR ART

Thermostat gas valves for cooking ovens are already known. They are operated by mechanical means modulating the oven burner gas flow to regulate the temperature of the oven sensed by a device of an hydraulic type operated by an expandable liquid, such as that disclosed in U.S. Pat. No. 3,841,552, and where the gas inlet pipe has a built-in electromagnetic safety valve fed by a thermocouple heated by the burner flame.

Combustion control systems for gas burners are also known, such as for instance the one disclosed in U.S. Pat. No. 3,963,410, provided with two valves for controlling the burner gas flow, the first of which is a manual valve with a rotary knob and the second is a solenoid valve for regulating the flow by means of an ON-OFF cycle. The rotary knob closes a microswitch connecting the A.C. electrical power to the electronic ignitor and flame rectification circuits for the flame presence detection. This known system of combustion control in an oven uses an electronic type temperature sensor actuating on a solenoid valve, which has the function of regulating the temperature by electronic means, which need an electric power supply all the time.

The publication U.S. Pat. No. 3,832,123 discloses an ignition control system in a gas burner, provided with a solenoid valve for regulating the gas flow, a flame rectification sensor, and a sparking circuit which operates at an initial step—pre-ignition—and at a re-establishment step in case the flame goes out later—re-ignition—, and a timer circuit in cooperation with a power line microswitch, keeping the solenoid valve open during this period and the sparking circuit connected. The solenoid valve is fed all the time with the AC supply voltage, as long as a flame detection signal is present.

SUMMARY OF THE INVENTION

The object of the invention is a combustion control system, including a cooking oven burner supplied with a main gas flow by way of a thermostat valve operated by mechanical modulating means for the regulation of oven temperature, and an electromagnetic valve energized by a thermocouple heated by the main burner flame, and built into a gas inlet pipe in the body of the thermostat valve, in conjunction with an electronic control module for supplying the DC voltage to the safety valve electromagnet and the sparking circuit for igniting the main flame, which are combined with a flame detection circuit, and with the energizing generated by the thermostat valve thermocouple.

The combustion control system according to the invention permits normal working of the burner independently, for regulating the temperature and for protection of the burner against unwanted extinguishment by means of the thermoelectrically operated safety valve which cuts off the gas flow once the thermocouple has cooled down. In the event of loss of AC power supply to the oven, the thermocouple keeps the safety valve open, and the thermostat valve continues to modulate the oven burner heating flame in response to an independent temperature sensor.

The contribution of the invention is to provide a gas burner regulated by a thermostat valve of the existing thermoelectric safety type, with an electric coupling for ignition and flame control, by means of an electronic generation and control module in combination with the safety valve thermocouple, comprising a spark igniter for burner ignition, a voltage supply circuit for the safety valve electromagnet, an electronic flame detection circuit in combination with a spark igniter, and a timing circuit for automatic spark igniter activation during an initial pre-ignition step of a preset duration as well as during subsequent re-ignition intervals, and for the temporary application of this voltage for maintenance of the safety valve electromagnet open during the pre-ignition step in a parallel combination to the thermocouple energizing.

It is an advantage of the control system according to the invention which, after the manual reset of the electromagnet for the initial pre-ignition step, the safety valve is opened instantly and the user can release the knob immediately without having to wait for the thermocouple to warm up. Since it comes from the electronic module, the flame detection signal is established quickly when ignition takes place and it acts on an electric voltage supplier to keep the safety valve open, as long as the ignition step lasts.

It is also an advantage of the control system of the invention that, in case of failure in the establishment of the flame during the pre-ignition step, the timing and flame detection circuits conjointly limit the duration of the unburned gas escape interval in respect of the known combustion control systems provided only with a thermocouple as the flame detector, as flame absence is detected quickly by the electronic detection circuit after a short timed pre-ignition interval, and it cuts off the supply of gas flow by acting on the electromagnet supplier voltage circuit, without having to continue for a few seconds more so that the thermocouple is heated sufficiently.

In case of prolonged flame signal absence in the burner—for instance more than 10 seconds—, both whether this happens during the initial ignition step or at a subsequent re-ignition step, and in order to prevent the escape of gas into the atmosphere of the oven, the control system has a safety thermocouple connected to the electromagnetic valve, which in combination with the flame detection circuit and the timer, operates as a more reliable flame detector than the lock out circuit breakers used at the prior art, to abort oven operation. When the thermocouple ceases to maintain the safety valve due to its cooling down, the latter closes automatically by a return spring shutting off the gas flow.

DESCRIPTION OF THE PREFERRED EMBODIMENT

Figure 1:
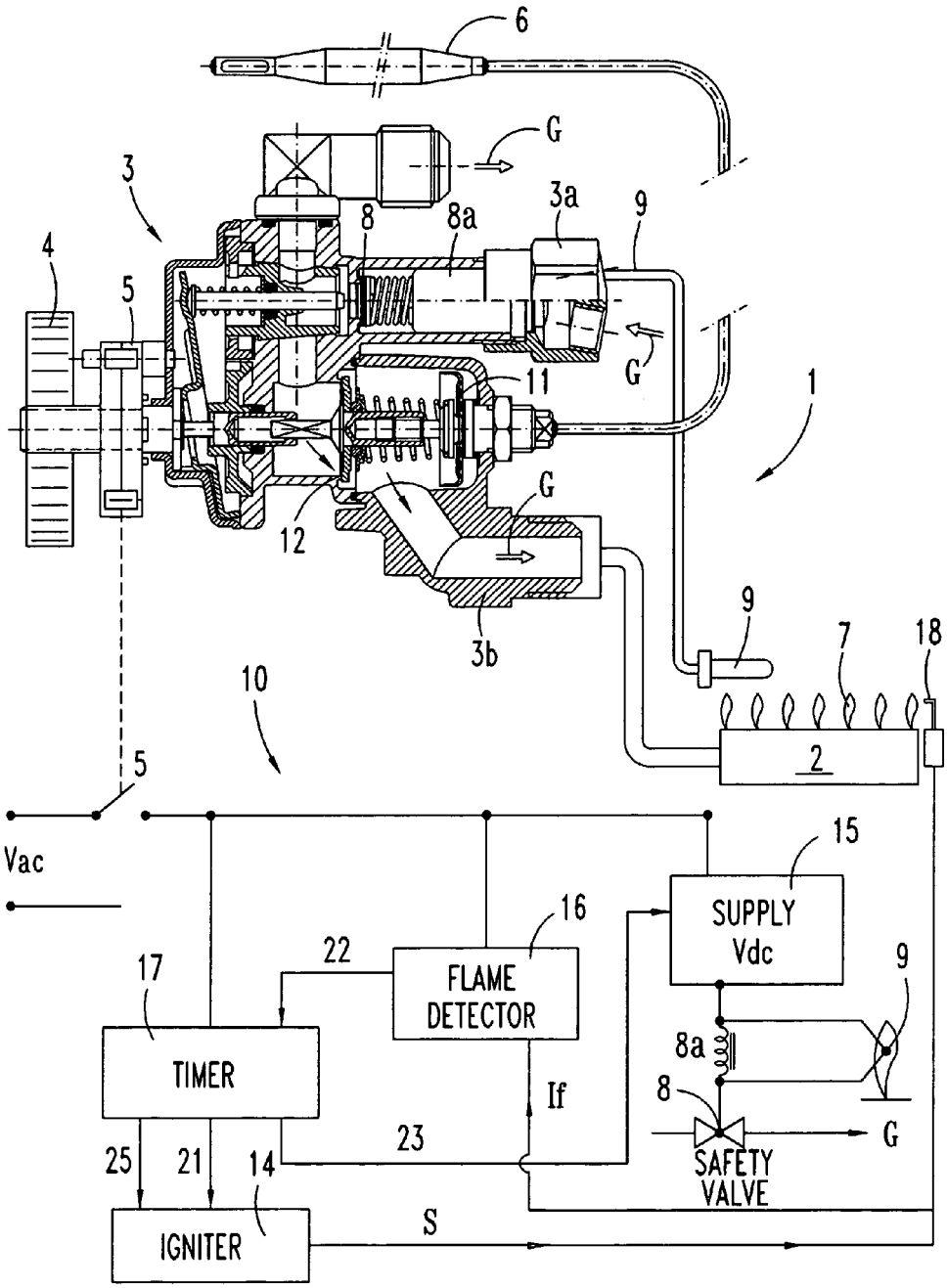
FIG. 1 is a diagrammatic view of the combustion control system, consisting of a gas burner, a thermostat valve with a built-in thermoelectric safety device and an electronic control module.

In reference to FIGS. 1–2, the embodiment of the combustion control system 1 described, having at least one main gas burner 2, is intended for a domestic cooking oven and comprises a thermostat valve 3 provided with a manual rotary knob 4 which activates a electronic control module 10 for the burner via a microswitch 5, whilst a gas supply "G" is modulated by a non-electric temperature sensor and mechanical means 11 for actuating a regulator closure member 12. The thermostat valve 3 is the conventional type for cooking ovens, with a temperature sensor 6 of the expandable liquid bulb type, wherein the body of the thermostat valve 3 includes a gas inlet 3*a* to the valve and at least one outlet 3*b* for transmitting the gas flow "G" to the burner, and a safety valve 8, which has an electromagnet 8*a* supplied by a thermocouple 9 heated by the main flame.

The electronic control module 10 comprises a sparking circuit or igniter 14 provided with an electrode 18, a DC voltage supply circuit 15 to the safety valve electromagnet 8*a*, maintaining the latter opened, a flame detection circuit 16 provided with a flame rectification electrode 18, the latter being preferably the actual sparking electrode, and a timing circuit for the supply of the DC voltage and of the sparking train "Sp" by the igniter 14. Manual depressing of the knob 4, while at the same time opens the safety valve and closes the microswitch 5, thereby the electronic control module 10 is connected to the 120 Vac power supply.

Figure 2A:
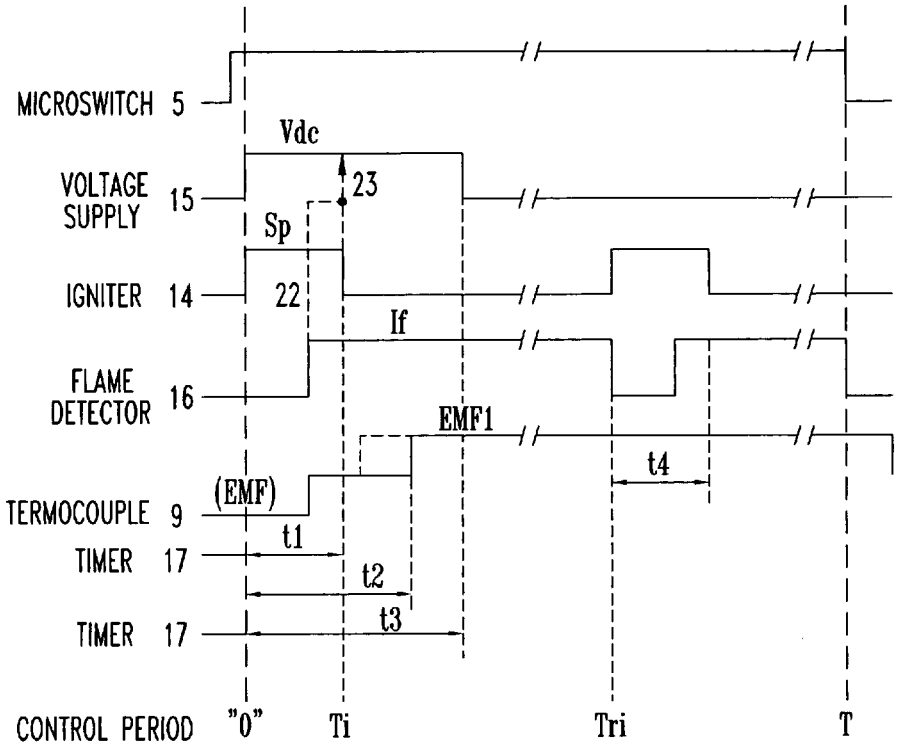
FIGS. 2A and 2B are diagrams representing a sequence of operations carried out by the control module on the burner of FIG. 1 in the course of the control time, in the cases of pre-ignition success and failure, respectively.
Figure 2B:
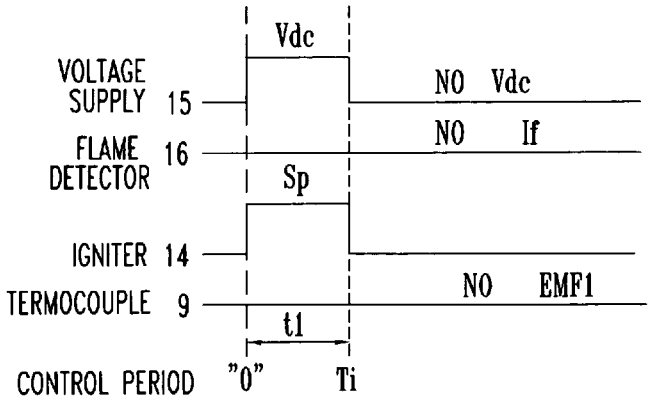

In reference to FIGS. 2A and 2B in zero combustion control time "0", the microswitch 5 enables control module 10 for the start of a burner pre-ignition step "Ti" with the sparking train "Sp". At the start "0" the DC voltage supply circuit 15 is also connected to the safety valve electromagnet 8*a*, so as to keep the gas delivery flow "G" open without the user's manual assistance. At the same time the timer circuit 17 transmits an igniter 14 activation signal 21 to produce a spark train at electrode 18, represented by line "Sp" in the diagram in FIGS. 2A and 2B. The sparking interval "t1" is fixed for each control module 10 and last around eight seconds, the minimum possible to prevent the build-up of unburned gas and long enough to achieve the gas ignition in normal conditions of the burner 2.

In reference to FIG. 2A, once the main flame 7 is established in the main burner, an electronic detection circuit 16 quickly establishes by way of electrode 18 a electric rectified current "If" representative of the presence of the flame 7, which remains throughout the period "T" of control of the electronic module 10, except during accidental intermediate extinguishment.

The flame 7 heats the thermocouple independent of the electronic module, generating the "EMF" as in FIG. 2A, rising up with heating time until reaching an EMF1 value high enough to keep the safety valve 8 open. The EMF1 maintenance value is reached in an interval "t2" lasting around 3–10 seconds, irrespective of the interval "t1" preset for the pre-ignition step. Detection of the flame current "If" activates a signal 22, enabling the timer 17, line 23 in FIG. 2A, for extending the supply of the DC voltage to the safety valve 8, which continues in its "open" condition still until a time "t3", which exceeds the rise interval "t2" of the thermocouple EMF1 value.

In reference to FIG. 2B, in the event of burner ignition failure, if absence of detection of the flame current in the pre-ignition period $T_i$ of control time interval "t1" occurs, the detection circuit 16 does not send the signal 22 directed to the timer 17 for the extension of time "t3". In order for the hazardous build-up of unburned gas to be prevented, the maintenance circuit 15 cuts off the supply of DC voltage at the end of preset time "t1". Due to the absence of the main flame 7, the thermocouple 9 is not heated either and the lack of EMF1 causes the safety valve 8 to close under the action of its return spring.

A second re-ignition step "Tri" is enabled during the combustion control, in the event of accidental extinguishment of the flame 7 and the subsequent missing of the flame current "If". In order to attempt re-establishment of the flame 7, the timer 17 sends a signal 25 for activation of igniter 14, the duration of which "t4" is limited to eight seconds, the same as the pre-ignition interval "t1". The supply of gas flow "G" to the burner continues by way of the burner 2, because the thermocouple EFM1 keeps the safety valve 8 open. In the case of a successful re-ignition, the flame current If is re-established and the control system 1 continues regulating the oven temperature. In the case of the re-ignition failure, the flame current "If" is not re-established and, in addition, the absence of flame 7 leads to a drop in the generated EMF value below the EFM1 maintenance value required, and the open safety valve 8 shuts off the entry of a gas flow into the thermostat valve 3.

Final shut-off of the safety valve 8 forces a new operation of the thermostat valve rotary knob 4 from its "OFF" position, for the manual resetting of the electromagnet 8*a* and the restart of a new pre-ignition step Ti.

What is claimed is:

1. A combustion control system having at least one gas burner with a main flame adapted to a domestic bake oven, comprising:

a thermostat valve provided with a regulator valve member and a valve body with a gas inlet and at least one gas flow outlet to be supplied to the burner, wherein the gas flow has been modulated by a temperature sensor of a hydraulic type in cooperation with mechanical means for actuating on the regulator valve member;

said thermostat valve having a built-in safety valve housed in said gas inlet, whose actuator electromagnet is kept energized by a thermocouple heated by the main flame after the end of an initial heating time period, and a rotary hand knob which actuates the safety valve mechanically opening it;

an electric microswitch operated by means of the thermostat valve hand knob;

an electronic module for controlling the burner which connected to the AC voltage supply by way of said microswitch, comprising a spark igniter with an ignition electrode activated during a pre-ignition step with a preset time of short duration, a flame detection circuit connected to a flame current rectification electrode, a circuit supplying a DC voltage to said electromagnet, for the maintenance of the safety valve open, and a timer circuit for a temporary connection of said DC voltage supply circuit to the electromagnet;

wherein during said pre-ignition step initiated by the microswitch, the flame detection circuit is connected to said AC voltage supply in combination with the timer circuit for supplying the DC voltage to the safety valve electromagnet, and temporary maintenance of the gas flow without the manual assistance of the rotary knob; and the timer circuit enabling the DC supply circuit for an interval of time, the interval of time depending on a result obtained from the flame rectification detector during the preset short time within the pre-ignition step, to maintain the energization of the safety valve if a flame is detected.

2. The combustion control system according to claim 1, wherein the activation of the igniter and the DC voltage supply circuit is timed for the interval of time, the interval being shorter than said thermocouple energizing time for maintenance of the safety valve, being the gas flow shut off at the end of said preset time for the pre-ignition step, in the event of detecting no flame rectification current, and when a flame current is detected, the detection circuit enables the timer circuit for the connection of the DC voltage supply circuit to the safety valve during an interval following the pre-ignition step, for a length of time that exceeds the duration of said thermocouple heating time.

3. The combustion control system according to claim 1, wherein during the regulation of the gas flow supplied to the burner, and being said detected flame rectification accidentally extinguished, the electronic module activates the igniter during a re-ignition step of short duration for the re-establishment of the main flame, while the gas flow in the burner is maintained by way of the safety valve energized by the flame thermocouple.

4. The combustion control system according to claim 1, wherein being the thermostat valve regulating the gas flow to the burner by means of said hydraulic temperature sensor and said mechanical means, in the event of a AC power shutdown disabling the electronic module, the gas flow to the burner is maintained by way of the safety valve energized by the thermocouple.

* * * * *